US006330844B1

(12) United States Patent
Walker

(10) Patent No.: US 6,330,844 B1
(45) Date of Patent: Dec. 18, 2001

(54) ULTIMATE NUT DRIVER

(76) Inventor: Russell Earl Walker, 7011 Wild Fern, San Antonio, TX (US) 78238

( * ) Notice: Subject to any disclaimer, the term of this patent is extended or adjusted under 35 U.S.C. 154(b) by 0 days.

(21) Appl. No.: 09/606,444

(22) Filed: Jun. 30, 2000

(51) Int. Cl.[7] ..... B25B 23/00
(52) U.S. Cl. ..... 81/439; 81/124.4
(58) Field of Search ..... 81/438, 439, 124.4, 81/177.2, 180.1

(56) References Cited

U.S. PATENT DOCUMENTS

| | | | | |
|---|---|---|---|---|
| 2,735,325 | * | 2/1956 | Rudd, Sr. | 81/439 |
| 2,758,494 | * | 8/1956 | Jenkins | 81/438 |
| 2,822,714 | * | 2/1958 | Paparelli | 81/439 |
| 2,878,701 | * | 3/1959 | Weersma | 81/438 |
| 2,991,678 | * | 7/1961 | Adolphson | 81/185 |
| 3,127,798 | * | 4/1964 | Gol | 81/439 |
| 4,279,314 | * | 7/1981 | Taub | 173/163 |
| 4,448,097 | * | 5/1984 | Rocca | 81/177.4 |
| 4,620,460 | * | 11/1986 | Gonzales, Jr. | 81/124.4 |
| 4,882,958 | * | 11/1989 | McNeeley | 81/124.4 |
| 5,943,924 | * | 8/1999 | Jarvis | 81/177.2 |

* cited by examiner

*Primary Examiner*—Joseph J. Hail, III
*Assistant Examiner*—David B. Thomas

(57) ABSTRACT

A self-contained multi-use tool for a range of screws, nuts and bolts sized, consisting of various screw bit and adapter including holder and a nut driver set, which fit together in a decreasing order and can be stored in an increasing order on the back or inside of the handle. Each socket head has a clearance hold to allow threaded bolts or rods of the associated nuts to extend through.

The screw bits and the adaptor can be stored on the holder or inside the opposite end of the handle.

4 Claims, 1 Drawing Sheet

ULTIMATE NUT DRIVER

CROSS REFERENCES TO RELATED APPLICATIONS

U.S. Pat. No. 4,620,460 Nov. 4, 1986—Frank Gonzales Jr.

U.S. Pat. No. 4,882,958 Nov. 28, 1989—Richard I McNeeley

U.S. Pat. No. 2,991,678 Jul. 11, 1961—Gottfrid Adolphson

U.S. Pat. No. 3,127,798 Apr. 7, 1964—Michael J. Gol

U.S. Pat. No. 4,399,723 Aug. 23, 1983—Gilles Marleau

BACKGROUND OF THE INVENTION

1. Field of the Invention

A small tool set particularly deep nut drivers where the nut drivers fit over each other in only one order with screw bits stored at the top of the handle. (see FIG. #4)

2. Description of the Related Art

Nut driver tools and sockets are similar except nut drivers have built in handles and sockets do not have built in handles.

Therefore inventions U.S. Pat. Nos. 4,620,460 and 4,882,985, also 2,991,678 can not be used without a lever or torque handle as my invention Ser. No. 09/606,444 can. Also noted that inventions U.S. Pat. No. 3,127,798 and invention U.S. Pat. No. 4,399,723 are a little more like my invention in that they have their own built in torque lever or handle. However, they are not hollow and cannot have long bolts or all thread rods put through them. The closest invention would be U.S. Pat. No. 4,399,723. The drawback between this invention and mine is the ease in retrieving the desired socket in my invention is far superior and far more efficient. My invention is deep drivers and stack only in one order over each other making it faster and easier to find and pull desired sizes. Also, the screw bits are easier to get to and use on my tool.

BRIEF SUMMARY OF THE INVENTION

With the aforementioned in mind, this present invention eliminates the shortcomings in prior art socket sets by providing such a set wherein the nut driver heads are deep and have a bolt or all tread rod clearance through sockets and handle as well. This is the only tool that can accomplish this without a lever or ratchet handle as it is built in. It is compact, convenient and thorough. The nut drivers stack in only one order with lock balls making it faster and easier to find the size nut driver you desire verses random order.

Although this tool is complete and made to be used independently, you can add a ratchet wrench at the butt of the handle where a ½" drive female adaptor is located and used primarily to hold nut drivers not in use. It is an ultimate tool.

DETAILED DESCRIPTION OF THE INVENTION

Figure 1:
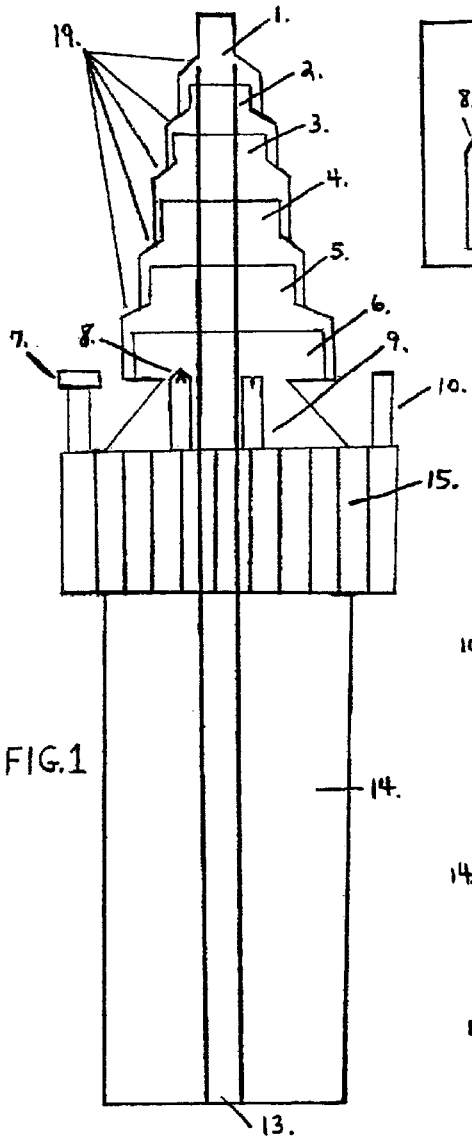
FIG. 1 is side view of complete tool and screw bits (dotted lines represent hollow shaft through tool).
Figure 2:
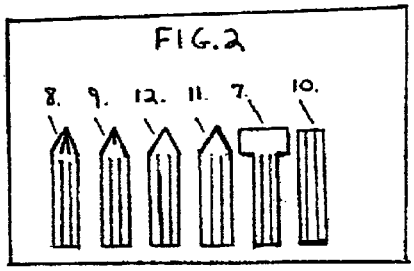
FIG. 2 view of screw bits.
Figure 3:
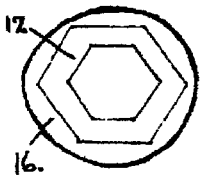
FIG. 3 top view of a single nut driver (applicable to drivers 2–6).
Figure 4:
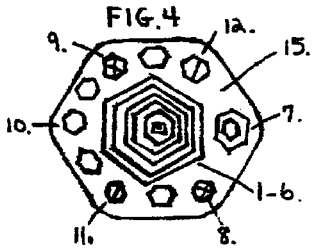
FIG. 4 top view of nut drivers also shows rubber ring that holds various screw bits FIG. 5 butt view of nut driver handle.
Figure 5:
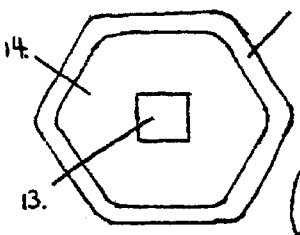
Figure 6:
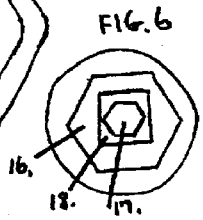
FIG. 6 top view of nut driver #1.

FIG. 1 is the entire side view of the tool. 1–6 of FIG. 1 is nut drivers in order 5/16"–5/8". Should you need #2 of FIG. 1 which is the 3/8 " you would pull off #1 of FIG. 1 and stick it in butt #13 of FIG. #18 of FIG. 6 shows how ½" drive adaptor fits in #13 of FIG. 5. All others 2–6 of FIG. 1 are all hexagon shape to also fit or follow No. 1 if they are not desired sizes needed. Shown on FIG. 3 #17 is the inside nut size. #16 locks onto #17 of the next sized nut driver with a hexagon shape and lock ball #19. The handle #14 is hollow shown on #13 and has at the top of the handle #15 a rubber grip with holes for screw bits as shown in FIG. 4. The bits are shown in FIG. 2. #7 in FIG. 2 is a 5/16 shaft ×¼" socket nut driver to hold other ¼" bits 8, 9, 10, 11, 12 of FIG. 2 and consisit of small and large phillips and flat screw driver tips also shown in FIG. 4. Located here there are extra holes available for the favorite bits you may have in your collection or toolbox that you would like to have handy on your nut driver tool set. This convenient Ultimate Nut Drivers can also be manufactured in metric sizes.

What is claimed is:

1. A self-contained multi-use tool consisting of set of nut drivers, various screw bits and an adaptor, which comprises a hollow elongated handle having a proximal end and a distal end and attached to said proximal end and a plurality of socket members, each of said plurality socket members has a working end with a cavity formed and sized to individually accommodate the head of a series of nuts or bolts of multiple sizes, which comprises of said sockets to include means of permitting the decreasing assembly of the nut driver members with respect to each other, and with the relative position of the individual sockets within the stack to facilitate the interchangeable usage of the members to ultimately accomplish the goal of the tool which is labor saving time by making the job easier and keeping absolute control of the loose pieces.

2. The tool of claim 1, wherein each socket comprises an open ended through hole concentric with the other socket members, when assembled together the socket member in use provides sufficient clearance to excess of length when working with extended rods or bolts.

3. Tool set of claim 1 wherein said tool is provided with an adaptor and a holder for optional and convenient storage of bits and said adaptor, wherein said holder provides extra space for additional bits, and said adaptor mounts into the smallest socket member of the proximal end of said handle allowing to mount any individual screw or bolt bit, eliminating the need of many extra screw and bolt drivers.

4. Tool set of claim 1 wherein said distal end of the handle is provided with an opening to serve as a built-in adaptor.

* * * * *